US009580274B2

(12) United States Patent
Nowel

(10) Patent No.: US 9,580,274 B2
(45) Date of Patent: Feb. 28, 2017

(54) INFORMATION EXCHANGE BETWEEN ELEVATOR SYSTEMS AND BUILDING SYSTEMS

(75) Inventor: Edward Nowel, Columbia, NJ (US)

(73) Assignee: Inventio AG, Hergiswil NW (CH)

( * ) Notice: Subject to any disclaimer, the term of this patent is extended or adjusted under 35 U.S.C. 154(b) by 1028 days.

(21) Appl. No.: 13/291,230

(22) Filed: Nov. 8, 2011

(65) Prior Publication Data

US 2013/0116835 A1 May 9, 2013

(51) Int. Cl.
*B66B 3/00* (2006.01)
*F24F 11/00* (2006.01)

(52) U.S. Cl.
CPC ..... *B66B 3/00* (2013.01); *F24F 11/0009* (2013.01)

(58) Field of Classification Search
CPC ..... F24F 11/0009; F24F 11/0034; F24F 2011/0068; B66B 1/2433; B66B 1/2466; B66B 2201/103; B66B 2201/222; B66B 2201/4661; B66B 2201/4615; B66B 2201/4623; B66B 2201/463; B66B 2201/224
See application file for complete search history.

(56) References Cited

U.S. PATENT DOCUMENTS

| | | | | |
|---|---|---|---|---|
| 6,909,921 | B1 | 6/2005 | Bilger | |
| 7,319,966 | B2 | 1/2008 | Friedli et al. | |
| 7,319,967 | B2 * | 1/2008 | Meyer | 705/305 |
| 7,319,968 | B2 | 1/2008 | Friedli et al. | |
| 7,711,565 | B1 * | 5/2010 | Gazdzinski | 704/270 |
| 8,374,725 | B1 * | 2/2013 | Ols | 700/277 |
| 2003/0177097 | A1 | 9/2003 | Friedli et al. | |
| 2004/0010328 | A1 * | 1/2004 | Carson et al. | 700/90 |
| 2004/0205191 | A1 | 10/2004 | Smith et al. | |
| 2006/0041632 | A1 * | 2/2006 | Shah et al. | 709/217 |
| 2008/0304512 | A1 * | 12/2008 | Jung et al. | 370/464 |
| 2009/0065596 | A1 * | 3/2009 | Seem et al. | 236/51 |
| 2009/0294221 | A1 * | 12/2009 | Bahjat et al. | 187/396 |
| 2010/0078266 | A1 * | 4/2010 | Choi | 187/247 |
| 2010/0217669 | A1 * | 8/2010 | Gazdzinski | G06Q 30/0251 705/14.52 |

FOREIGN PATENT DOCUMENTS

| | | | |
|---|---|---|---|
| CN | 201890697 | U | 7/2011 |
| JP | 2006125720 | | 5/2006 |
| JP | 2006342978 | | 12/2006 |
| JP | 2008281239 | | 11/2008 |
| JP | 2009024906 | | 2/2009 |
| JP | 2011-152995 | A | 8/2011 |
| KR | 20090073865 | | 7/2009 |
| KR | 10-1006204 | B1 | 1/2011 |
| TW | 201022604 | A | 6/2010 |

OTHER PUBLICATIONS

Examination Report issued on Nov. 18, 2016 in U.K. Patent Application No. 1407407.4.

* cited by examiner

*Primary Examiner* — Christopher E Everett
(74) *Attorney, Agent, or Firm* — Stroock & Stroock & Lavan LLP

(57) ABSTRACT

Environment information associated with a user can be exchanged between an elevator system and a building environmental system. The user can adjust environmental settings in one context (e.g., in an elevator car of the elevator system), and the settings can be carried over to another context (e.g., a room serviced by the building environmental system). Information exchange can be aided by a database that records information for user preferences.

17 Claims, 5 Drawing Sheets

INFORMATION EXCHANGE BETWEEN ELEVATOR SYSTEMS AND BUILDING SYSTEMS

FIELD

This disclosure relates to information exchange between elevator systems (e.g., elevator environmental systems) and building systems (e.g., building environmental systems).

BACKGROUND

Generally, people in buildings like to have some degree of control over environmental features such as lighting, HVAC (heating, ventilation, air conditioning) and/or multimedia. For example, people sometimes wish to adjust the room temperature. More flexible management of environmental features could be useful in buildings.

SUMMARY

In at least some embodiments, environmental information associated with a user can be exchanged between an elevator system and a building environmental system. A user can adjust environmental settings in one context (e.g., in an elevator car of the elevator system), and the settings can be carried over to another context (e.g., a room serviced by the building environmental system). Information exchange can be aided by a database that records information for user preferences.

Some embodiments of a method comprise: receiving a user's environment input information for one of an elevator system and a building environment system, the user being in an area served by the one of the elevator system and the building environment system; updating a user profile based on the received environment input information; and operating a component of the other of the elevator system and the building environment system based on the updated user profile. In some cases, the environment input information is for the elevator system and the component is of the building environment system. In further cases, the environment input information is for the building environment system and the component is of the elevator system. Operating the component can comprise adjusting lighting of an area served by the other of the elevator system and the building environment system, adjusting a temperature of an area served by the other of the elevator system and the building environment system, and/or activating a multimedia component of an area served by the other of the elevator system and the building environment system. The user's input information can be one of a set of repeated user inputs. The method can further comprise determining that the user's environment input information is within an allowable range for environment input information.

Embodiments of an elevator installation can comprise: an elevator car, the elevator car being coupled to one or more environmental components for the elevator car; a user profile database; and an elevator control computer, the elevator control computer being coupled to the user profile database and being configured to receive first user environment input information from a user in the elevator car, store the first user environment input information in the user profile database, retrieve second user environment input information from the user profile database, the user profile database having been modified based on information provided by a building environment system, and operate the one or more environmental components based on the retrieved second user environment input information. The one or more environmental components can comprise a lighting device, a multimedia device and/or an HVAC device.

Embodiments of a building environmental system for use with an elevator system can comprise: a building control computer; and one or more environmental components for at least one room in a building, the building control computer being configured to receive a first user environment input information from a user in the at least one room, store the first user environment input information in a user profile database, retrieve a second user environment input information from the user profile database, the user profile database having been modified based on information provided by the elevator system, and operate the one or more environmental components based on the retrieved second user environment input information.

Exemplary embodiments of a system comprise: an elevator control computer; a building control computer; a user profile database coupled to the elevator control computer and to the building control computer; an elevator environmental component coupled to the elevator control computer; a building environmental component coupled to the building control computer; and an environment information input device coupled to the elevator control computer or to the building control computer. The one or more environmental components can comprise a lighting device, a multimedia device and/or an HVAC device.

Exemplary embodiments of a building environmental system for use with an elevator system comprise: a building control computer; and one or more environmental components for at least one room in a building, the building control computer being configured to receive a first user environment input information from a user in the at least one room, store the first user environment input information in a user profile database, retrieve a second user environment input information from the user profile database, the user profile database having been modified based on information provided by the elevator system, and operate the one or more environmental components based on the retrieved second user environment input information.

Further embodiments of a system comprise: an elevator control computer; a building control computer; a user profile database coupled to the elevator control computer and to the building control computer; an elevator environmental component coupled to the elevator control computer; a building environmental component coupled to the building control computer; and an environment information input device coupled to the elevator control computer or to the building control computer. The system can further comprise a means for identifying a passenger. The environment information input device can be coupled to the elevator control computer and be a first environment information input device, the system further comprising a second environment information input device, the second environment information input device being coupled to the building control computer. The user profile database can be located remotely from at least one of the elevator control computer and the building control computer.

At least some embodiments of the disclosed methods can be implemented using a computer or computer-based device that performs one or more method acts, the computer having read instructions for performing the method acts from one or more computer-readable storage media.

DETAILED DESCRIPTION

Figure 1:
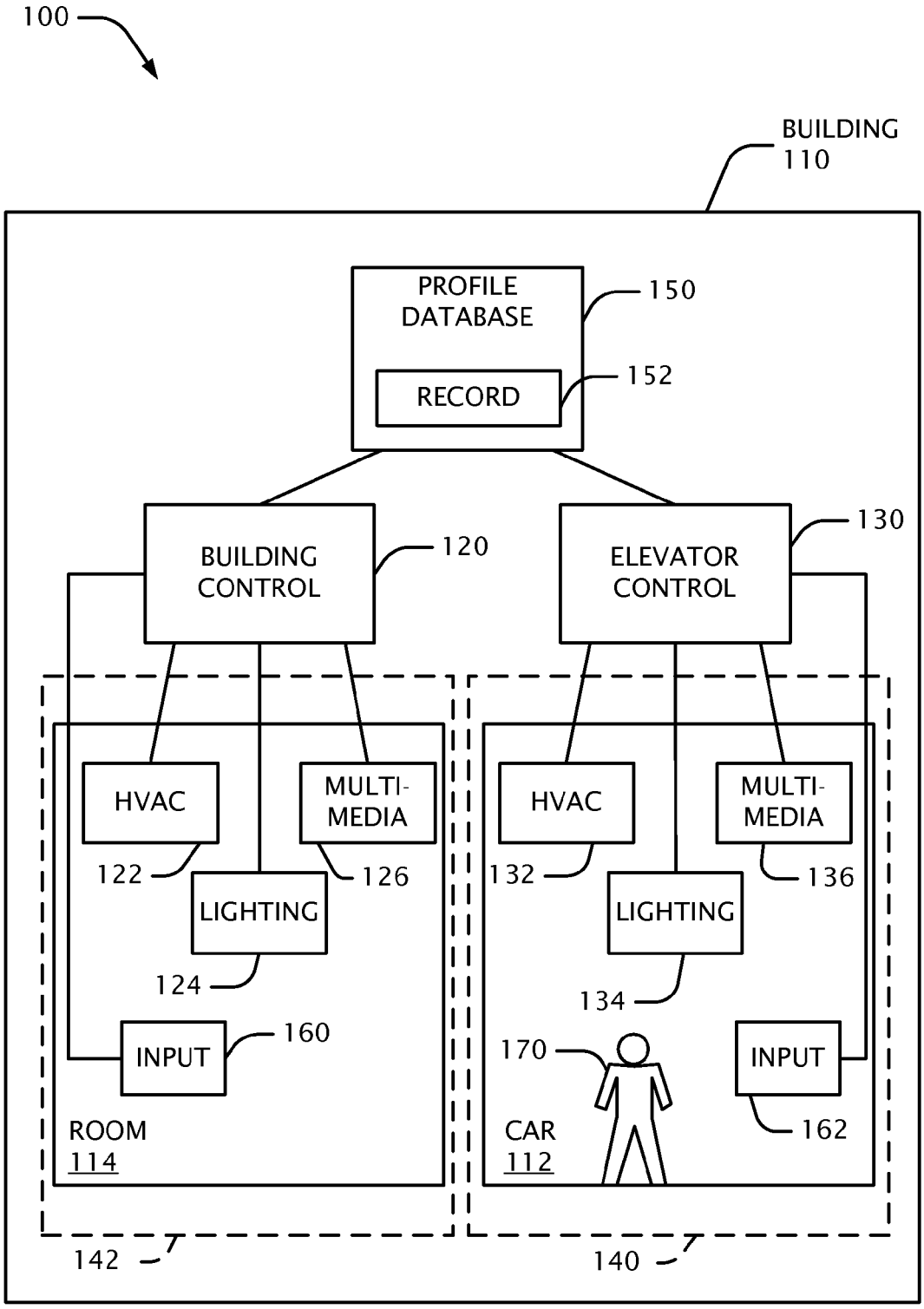
FIG. 1 shows a block diagram of an exemplary embodiment of a system for controlling environmental components.

Disclosed below are embodiments of elevator control and building control technologies and/or related systems and methods. The embodiments should not be construed as limiting in any way. Instead, the present disclosure is directed toward all novel and nonobvious features and aspects of the various disclosed methods and systems, and equivalents thereof, alone and in various combinations and sub-combinations with one another. The methods disclosed herein are not performed purely in the human mind.

As used in this application and in the claims, the singular forms "a," "an" and "the" include the plural forms unless the context clearly dictates otherwise. Additionally, the term "includes" means "comprises." When used in a sentence, the phrase "and/or" can mean "one or more of" the elements described in the sentence. Embodiments described herein are exemplary embodiments of the disclosed technologies unless clearly stated otherwise.

Although the operations of some of the disclosed methods and systems are described in a particular, sequential order for convenient presentation, it should be understood that this manner of description encompasses rearrangement, unless a particular ordering is required by specific language set forth herein. For example, operations described sequentially can in some cases be rearranged or performed concurrently.

For the sake of simplicity, the figures may not show the various ways in which the disclosed methods and systems can be used in conjunction with other methods and systems. Additionally, the description sometimes uses terms like "receive," "update" and "operate" to describe the disclosed technologies. These and other terms are high-level abstractions of the actual operations that are performed. The actual operations that correspond to these terms may vary depending on the particular implementation and are readily discernible by one of ordinary skill in the art.

Any of the methods described herein can be performed using software comprising computer-executable instructions stored on one or more computer-readable storage media. Furthermore, any intermediate or final results of the disclosed methods can be stored on one or more computer-readable storage media. Computer-readable storage media can include non-volatile storage such as, for example, read-only memory (ROM), flash memory, hard disk drives, floppy disks and optical disks. Computer-readable storage media can also include volatile storage such as, for example, random-access memory (RAM), device registers and processor registers. Any such software can be executed on a single computer or on a networked computer (networked, for example, via the Internet, a wide-area network, a local-area network, a client-server network, or other such network). Computer-readable storage media do not include embodiments that are pure transitory signals.

For clarity, only certain selected aspects of the software-based implementations are described. Other details that are well known in the art are omitted. For example, it should be understood that the disclosed technologies are not limited to any specific computer language, program, or computer. For instance, the disclosed embodiments can be implemented using a wide variety of commercially available computer systems. Any of the disclosed methods can alternatively be implemented (partially or completely) in hardware. Portions of one or more disclosed methods can be executed by different parts of a distributed computing environment.

Additionally, intermediate or final results (e.g., one or more user settings) created or modified using any of the disclosed methods can be stored on one or more tangible computer-readable storage media.

Furthermore, any of the software embodiments (comprising, for example, computer-executable instructions for causing a computer to perform any of the disclosed methods) can be transmitted, received, or accessed through a suitable communication means. Similarly, intermediate or final method results, created or modified using any of the disclosed methods, can be transmitted, received, or accessed through a suitable communication means. Such suitable communication means include, for example, the Internet, an intranet, cable (including fiber optic cable), magnetic communication means, electromagnetic communication means (including RF, microwave, and infrared communications), electronic communication means, or other such communication means. Such communication means can be, for example, part of a shared or private network. Various embodiments of one or more electronic devices can be used with at least some of the disclosed technologies, including a handheld computing device (e.g., a personal digital assistant (PDA), a cell phone, a smartphone, a portable music or video player) and a personal computer (e.g., a desktop computer, a laptop computer, a netbook, a server, a thin client). At least some electronic devices can be configured to receive data from and/or transmit data to a network (e.g., a wireless network, the Internet).

FIG. 1 shows a block diagram of an exemplary embodiment of a system 100 for controlling environmental components. At least a portion of the system 100 is located within a building 110. The system 100 comprises a building control unit 120 and an elevator control unit 130. Each of the units 120, 130 comprises a computer-based device.

In some embodiments, the building control unit 120 comprises a centralized building computer system. The building control unit 120 can also comprise a building security system and/or an environmental automation control system. In further embodiments, the building control unit 120 stores information about particular users and/or occupants (e.g., persons or businesses) of the building 110. In some embodiments, the building control unit 120 comprises a centralized computer, while in other embodiments the unit 120 comprises a set of distributed (but connected) computer systems.

The building control unit 120 is coupled to and controls the operation of one or more environmental components, which make up a building environment system 142. Environmental components are generally devices that serve an area (such as a room 114 and/or an elevator car 112) by altering some environmental aspect of the area. In various embodiments, examples of environmental components include (but are not limited to): an HVAC device 122, which can include a heating, ventilation and/or air conditioning device for at least a portion of the building 110, and one or more sensors (e.g., temperature sensors); a lighting device 124 (e.g., a lamp), which can provide lighting for at least a portion of the building 110; and a multimedia device 126, which can include, for example, audio and/or video devices for at least a portion of the building 110.

Although the environmental components are depicted in FIG. 1 as being inside the room 114 and inside the car 130, in some embodiments one or more respective environmental components are located outside of the room 114 and/or the car 112.

Although FIG. 1 depicts only one room 114, in various embodiments the system 100 can serve multiple rooms in the building 110. The rooms can include, for example, offices, apartments, retail areas, gyms and/or eating areas (e.g., cafeterias or restaurants). Each of these rooms can have one or more respective environmental components coupled to the building control 120. However, in at least some embodiments, not every room in the building 110 has environmental components coupled to the building control 120.

In some embodiments, the elevator control unit 130 is part of the elevator controller hardware that operates various components of the elevator system, such as processing calls, operating doors and/or analyzing traffic data. In further embodiments, the control unit 130 is a computer-based unit that is separate from (but communicatively coupled to) the elevator controller hardware.

The elevator control unit 130 is coupled to and controls the operation of one or more environmental components for an elevator system 140 that serves the building 110. In various embodiments, examples of environmental components include: an HVAC device 132, which can include a heating, ventilation and/or air conditioning device for one or more elevator cars 112, and one or more sensors (e.g., temperature sensors); a lighting device 134 (e.g., a lamp), which can provide lighting for one or more elevator cars; and a multimedia component 136, which can include, for example, audio and/or video devices for one or more elevator cars. In further embodiments, the elevator control 130 controls the operation of one or more environmental components that affect the environment outside of an elevator car.

The building control unit 120 and the elevator control unit 130 are both coupled to a profile database 150. The database 150 comprises at least one computer-readable storage medium and stores one or more records 152, each of which is associated with a given user 170. In some embodiments, a record 152 (also called a "profile") is associated with two or more users. In further embodiments, the record 152 is associated with users who belong to a group or organization associated with the building 110 (e.g., employees of a tenant of the building 110). The records 152 indicate one or more environmental preferences for the associated users. For example, the preferences can indicate: a temperature or temperature range preferred or required by the user; lighting levels preferred or required by the user; music, video or other multimedia content preferred or required by the user; and/or marketing preferences for the user. In particular embodiments, the preferences indicate that certain images should be shown on one or more walls of the car 112 and/or the room 114. In various embodiments, the preferences stored by the records 152 can indicate positive preferences (e.g., "likes") and/or negative preferences (e.g., "dislikes"). For example, a record can indicate that its associated user prefers classical music, or that the user dislikes jazz music and thus prefers any music but jazz. In some embodiments, the database 150 is incorporated into the building control unit 120 and/or into the elevator control unit 130.

Although a user (also sometimes called a passenger, visitor, or occupant) can be a person, in various embodiments the user 170 can also be multiple people, a machine, an animal, and/or another object.

The system 100 further comprises an input device 160, which is coupled to the building control unit 120. The input device 160 in the room 114 allows a user to provide information to the building control unit 120 about the user's environmental preferences for one or more areas in the building 110. An input device 162 in the car 112 is also coupled to the elevator control unit 130. The input device 162 allows a user to provide information to the elevator control unit 130 about the user's environmental preferences for one or more elevator cars. The input devices 160, 162 can comprise, for example, a keypad, a touchpad, a computing device and/or a portable electronic device (e.g., a remote control, a mobile telephone, a smartphone, a personal digital assistant). In some embodiments, only one of the input devices 160, 162 is present. In further embodiments, one or more additional input devices are coupled to the building control unit 120 or the elevator control unit 130.

The building control 120 and/or the elevator control 130 can at least partially determine the location and the identity of the user 170. For example, the location of the user 170 can be determined well enough to establish that the user 170 is in the car 112 or in the room 114. In some embodiments, the user location and identity is established at least in part by detecting the presence of an identification device borne by the user 170. The identification device can comprise, for example, a radio-frequency identification (RFID) tag (including near-field and far-field devices), a magnetic storage device (e.g., magnetic strip card), an optical code device, and/or another device. In further embodiments, the user location is established based on an input provided by the user 170 at, for example, the input device 160, 162. For example, the input device 160, 162 can read a biometric feature from the user 170 (e.g., a fingerprint, an iris scan, a voice print and/or other feature). The input device 160, 162 can also receive a code (e.g., a personal identification number (PIN) code) from the user 170. In particular embodiments, the user location is based on a signal from a portable electronic device borne by the user 170.

In some embodiments, the user 170 is identified on an individual level, while in further embodiments the user is identified in that he or she is associated with one or more groups of users.

In some embodiments, one or more components of the system 100 are located remotely from the building (e.g., the profile database 150 is located remotely).

Remote components can exchange information with components at the building 110 over one or more networks (not shown). In further embodiments, all of the components of the system 100 are located within the building 110.

Figure 2:
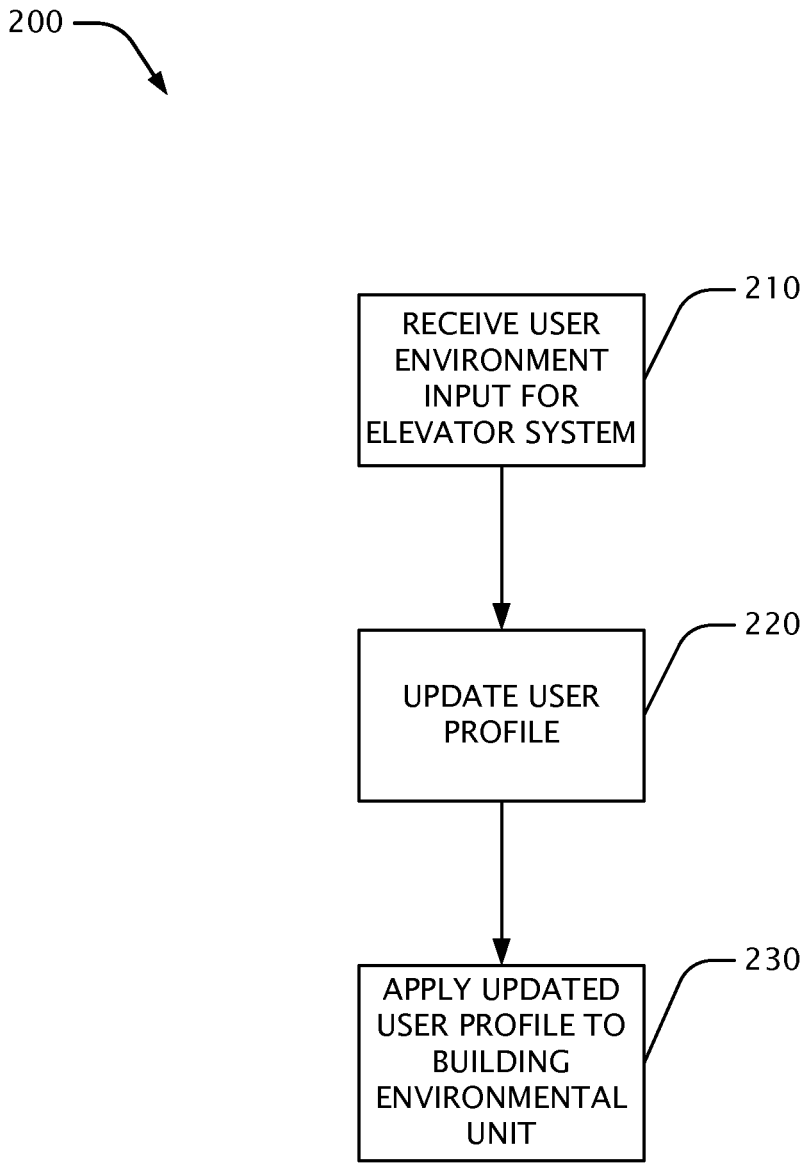
FIG. 2 shows a block diagram of an exemplary embodiment of a method for managing environmental features.

FIG. 2 shows a block diagram of an exemplary embodiment of a method 200 for managing environmental features in at least some embodiments of the system 100. In a method act 210, environment input information for an elevator system is received for a user (e.g., by the elevator system). In some cases, the user has been previously identified by the system 100. The input could indicate, for example, that the user would like the air temperature in the elevator car to be warmer or cooler, or that the interior car lights should be brighter. The elevator system makes the requested adjustments. In a method act 220, the elevator system also updates a profile for the user, such as a record 152 stored in the profile database 150. The updated record 152 thus contains the user's indicated preference (e.g., for temperature, lighting, and/or other indicated environment input). In a method act 230, at least a portion of the information in this updated user profile is used by the building control unit 120 to control one or more of the building environmental components. For example, the building control unit 120 can use information from the profile to operate the HVAC device 122.

Generally, and unless stated otherwise, method acts described herein as being performed by the elevator system can be performed by the elevator control unit 130 in at least some embodiments.

Following is a non-limiting example of an application of one version of the method 200. A user enters an elevator car to be transported to a destination floor. The user is wearing an RFID-tag-based card, which identifies the user to the elevator system. While in the car, the user indicates to the elevator system, through an input device, that he wants the cabin air temperature to be 20 degrees C. The elevator system updates the user's profile in the profile database. The elevator system also adjusts the temperature in the car and delivers the passenger to his destination floor, where the user's office is located. The building control unit reads the updated user profile from the profile database and obtains the user's temperature information. Based on the temperature information, the building control unit sets the user's office temperature to 20 degrees C. Environmental preferences from the user's elevator ride are thus used in managing the environment of the user's office. This can allow the user to be more consistently comfortable in the elevator car and in the office.

Figure 3:
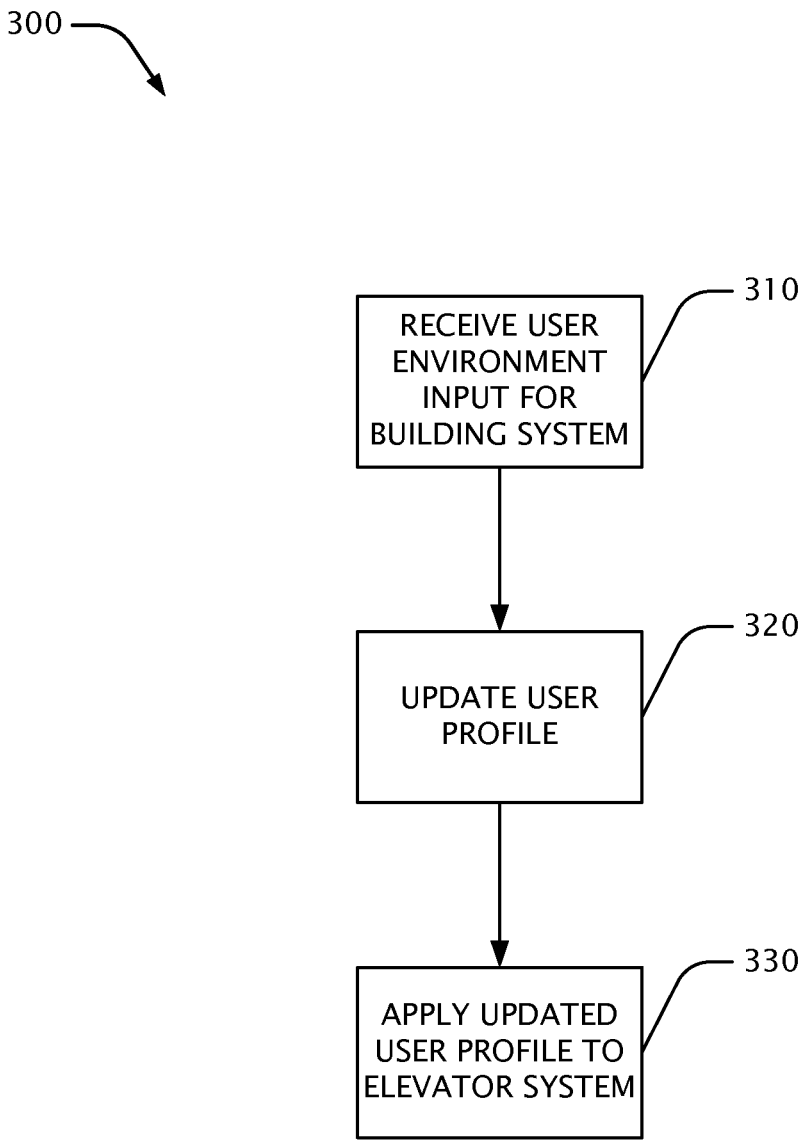
FIG. 3 shows a block diagram of another exemplary embodiment of a method for managing environmental features.

FIG. 3 shows a block diagram of an exemplary embodiment of a method 300 for managing environmental features in at least some embodiments of the system 100. In a method act 310, environment input information for a building system is received for a user (e.g., by the building system). The input could indicate, for example, that the user would like the air temperature in a room in the building to be warmer or cooler, or that the room's lights should be brighter. The building system makes the requested adjustments. In a method act 320, the building system also updates a profile for the user, such as a record 152 stored in the profile database 150. The updated record 152 thus contains the user's indicated preference (e.g., for temperature, lighting, and/or other indicated environment input). In a method act 330, at least a portion of the information in this updated user profile is used by the elevator control unit 130 to control one or more of the elevator environmental units. For example, the elevator control unit can use information from the profile to set the lighting for the car 112.

Generally, and unless stated otherwise, method acts described herein as being performed by the building system can be performed by the building control unit 120 in at least some embodiments.

Following is a non-limiting example of an application of an embodiment of the method 300. A user indicates to the building control unit, through an input device in his apartment, that the user wishes to have a certain type of music played in his apartment. The building control unit updates the user's profile in the profile database with this information. The building control unit also causes the music system in the apartment to play the requested music. The user leaves the apartment and enters an elevator to travel to another portion of the building. Upon detecting the user's presence in the elevator, the elevator control unit reads the updated user profile from the profile database and obtains the user's music preference information. Based on the music preference information, the elevator control unit causes the requested music to be played in the elevator car during the user's trip. Thus, the user's environmental preferences can be applied to both the apartment and the elevator car.

In further embodiments, a system can perform one or more versions of both of the methods 200 and 300. For example, both the building control unit 120 and the elevator control unit 130 can receive user environment input from input panels and update or create records 152 in the profile database 150. Each of the control units 120, 130 can also read the records 152 for one or more users to obtain environmental preference information. Thus, the building control unit 120 can exchange environmental preference information with the elevator control unit 130. In at least some cases, this can allow for more uniform application of environmental settings between elevator cars and building rooms. The control units 120, 130 can "learn" from each other the proper environmental settings for a given user. For example, after a user adjusts temperature, lighting and/or multimedia settings in a building room, the elevator control unit can attempt to match those settings in an elevator car that later transports the user. The learning by the control units 120, 130 can occur using, for example: an average of user inputs; artificial intelligence algorithms; neural networks; and/or pattern recognition algorithms.

In particular embodiments, a building system and an elevator system can communicate and "agree" on one or more parameter values or ranges for user inputs. In one example, a building system is configured to allow a maximum room temperature of 20 degrees C. The elevator system does not have a maximum room temperature. A user may request that the room temperature in his office be set at 23 degrees C. This information will be stored in in the user profile database. However, because of its temperature limit, the building system will raise the office room temperature to only 20 degrees C. The elevator system will also implement this temperature limit, thus "agreeing" with the building system.

At least some embodiments thus allow for a more consistent, responsive, personalized and/or automated user experience. Elevator system and building environmental systems can adapt to and learn a given user's environmental preferences.

In some embodiments, the record 152 in the profile database 150 is revised only after a user manually overrides a setting a certain number of times (e.g., two times, three times, or another number of times). In additional cases, the system 100 reacts to repeated inputs from the user 170, over a period of time, by revising the record 152 for the user. In one example, over the course of several days or visits, a user repeatedly sets the room temperature and/or elevator car temperature to 23 degrees C., while the default temperature value is 20 degrees C. As a result of these repeated requests, the record 152 for the user 170 is revised to reflect the user's temperature preference.

In further embodiments, the revision of data in a record 152 is subject to restrictions by one or more parties (e.g., a building manager). In some cases, passenger environmental preferences are not implemented if, for example, this would result in high utility costs or have other adverse effects. In further cases, passenger environmental preferences are partially implemented according to one or more restrictions.

In still further embodiments of the disclosed methods, the system 100 applies information from a plurality of user profiles stored in the profile database 150. This can arise when a room 114 or a car 112 is occupied by multiple individuals who collectively have multiple profiles. In such situations, the system 100 can compare the multiple profiles and apply environmental preferences that the profiles have in common or have largely in common For example, if the system 100 determines that three passengers in the elevator car 112 all prefer classical music, the elevator control 130 can apply this preference to the multimedia component 136. The same passengers may, however, have conflicting settings in their profiles for lighting (e.g., one passenger prefers dim lights, while another passenger prefers bright lights). Conflicting settings can be resolved in one or more ways, for example, by resorting to a default setting and/or by giving priority to the settings of one or more profiles (e.g., because those profiles belong to important persons).

Figure 4:
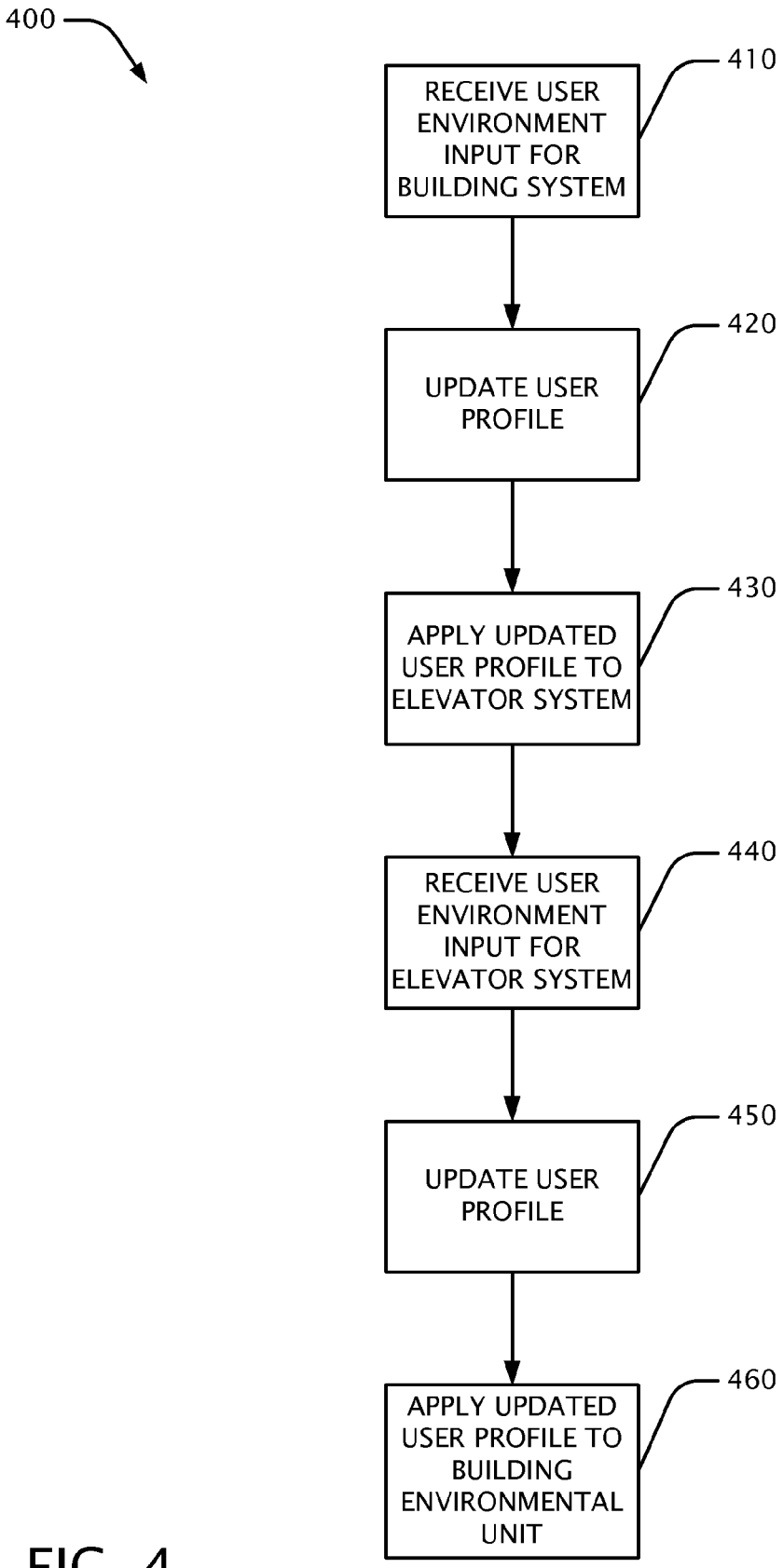
FIG. 4 shows a block diagram of another exemplary embodiment of a method for managing environmental features.

Further embodiments of the disclosed technologies exchange information in two directions between the building system and the elevator system. For example, FIG. 4 shows a block diagram of an exemplary embodiment of a method 400 for managing environmental features. In a method act 410, environment input for a user is received by a building system. In a method act 420, a building control unit updates a profile for the user based on the received input. In a method act 430, information from the updated user profile is applied to an environmental component of an elevator system. Then, in a method act 440, the elevator system receives environment input for the user. In a method act 450, the elevator system updates the profile for the user based on the received input. In a method act 460, the building control unit applies information from the newly updated user profile to a building environmental component.

In further embodiments, the method acts of the method 400 can be performed in a different order. For example, the acts can be performed in this order: 440, 450, 460, 410, 420 and then 430.

Figure 5:
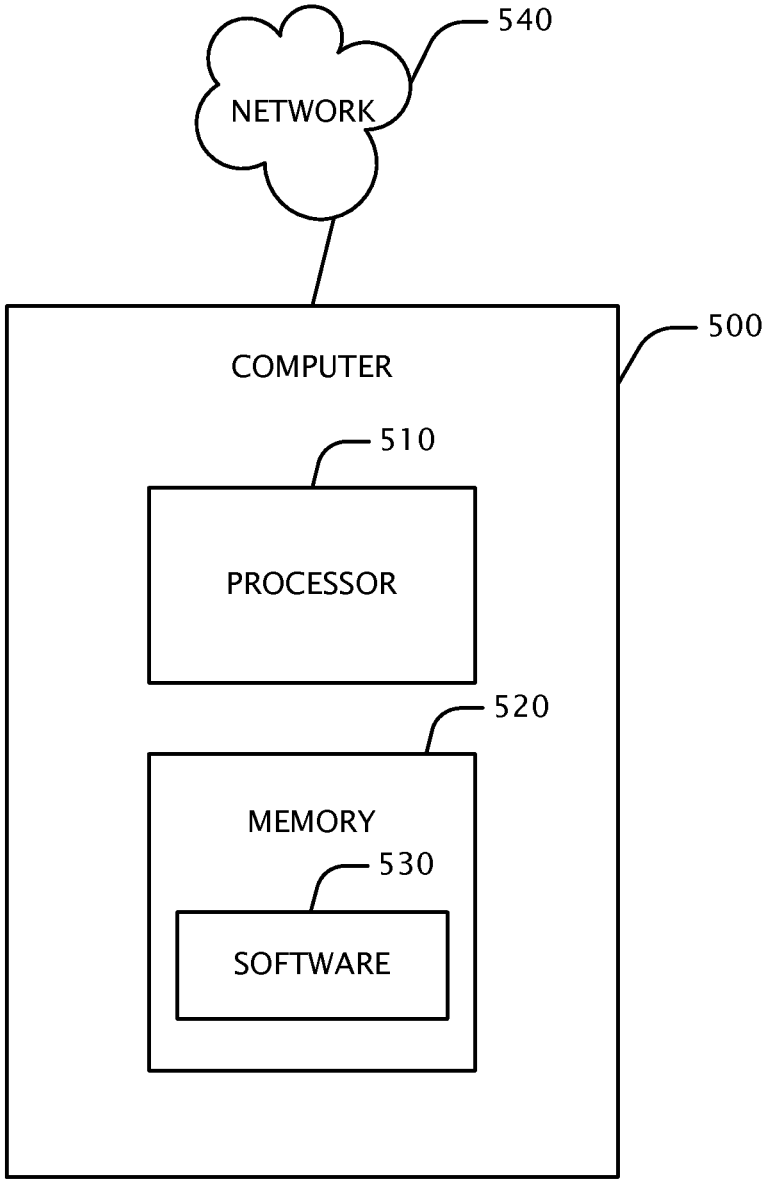
FIG. 5 shows an exemplary embodiment of a computer.

FIG. 5 shows a block diagram of an exemplary embodiment of a computer 500 (e.g., part of an elevator control unit, part of a building control unit) that can be used with one or more technologies disclosed herein. The computer 500 comprises one or more processors 510, which can comprise physical processors and/or virtual processors. The processor 510 is coupled to a memory 520, which comprises one or more computer-readable storage media storing software instructions 530. When executed by the processor 510, the software instructions 530 cause the processor 510 to perform one or more method acts disclosed herein. Further embodiments of the computer 500 can comprise one or more additional components. For example, the computer 510 can comprise one or more networks 540 for communicating with one or more other electronic components.

Following is a non-limiting example of an application of at least some embodiments of the disclosed technologies. In this example, a user enters a building lobby and uses an ID card to place a destination call for the elevator system. The user enters the allocated elevator car to travel to her destination floor, where her office is located. While in the car, she indicates to the elevator system that she would like the car temperature to be two degrees warmer. She provides this indication using an application running on her mobile telephone. In response, the elevator system increases the car temperature by two degrees. The elevator system stores this information in the user's record in the profile database. After the user arrives at the destination floor and leaves the elevator car, she enters her office. Her arrival at the office is detected by the building control unit based on the user's ID card. The building control unit reads the user's record in the profile database. Based on the temperature information in the record (which was recently updated by the elevator system), the building control unit instructs the HVAC unit for the office to bring the air temperature of the office to the temperature that the user indicated for the elevator car. During her time in the office, the user indicates that she would like the office air temperature increased by an additional two degrees, and that she would like the office lighting to be ten percent brighter. This information about the room temperature and lighting is stored by the building control unit in the user's profile database record. The user later leaves the office and requests an elevator car for traveling to the building lobby. Once in her assigned car, the elevator system reads the updated lighting and temperature information from the user's profile database record. The elevator adjusts the heating and lighting conditions in the elevator car accordingly. Thus, the user's wishes for environmental conditions are consistent across the elevator system and the building system (e.g., in the user's office).

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. A method of influencing an environment in a building area having an associated building environment control system serving the building area, an environment in a separate elevator area associated with an elevator control system, comprising:

identifying a user of the elevator system;

receiving, at an input device for an elevator car, environment input information of the user for the elevator control system controlling elevator systems for the elevator car and operations of the elevator car responsive to elevator calls;

receiving, at the elevator control system, the environment input information from the input device for the elevator car;

operating, by the elevator control system, an environmental component of the elevator system based upon the environment input information;

updating a user profile based on the received environment input information, the user profile stored in a database communicatively coupled to the elevator control system and to the separate building environment control system that controls building systems for the building area, wherein the database comprises at least one computer-readable storage medium storing one or more records, each of which is associated with a given user and indicates one or more environmental preferences of the user;

reading the updated user profile by the building environment control system; and operating a component of the building systems based on the updated user profile.

2. The method of claim 1, the operating the component comprising adjusting lighting of an area served by building systems.

3. The method of claim 1, the operating the component comprising adjusting a temperature of an area served by the building systems.

4. The method of claim 1, the operating the component comprising activating a multimedia component of an area served by the building systems.

5. The method of claim 1, the user's input information being one of a set of repeated user inputs to override a default value applied to the user profile.

6. The method of claim 1, further comprising determining that the user's environment input information is within an allowable range for environment input information.

7. An elevator installation, comprising:

an elevator car, the elevator car being coupled to one or more environmental components for the elevator car;

a user profile database; and an elevator control computer communicatively coupled to hardware that controls operations of the elevator car in response to elevator calls, the elevator control computer being coupled to the user profile database and being configured to, identify a user of the elevator system, receive, from an input device in the elevator car, first user environment input information from a user in the elevator car, store the first user environment input information in the user profile database, wherein the profile database stores one or more records, each of which is associated with a given user and indicates one or more environmental preferences of the user, retrieve second user environment input information from the user profile database, the user profile database having been modified based on information provided by a separate building environment system, associated with an environment in a separate building area, coupled to the profile database, and operate the one or more environmental components for the elevator car based on the retrieved second user environment input information.

8. The elevator installation of claim 7, the one or more environmental components comprising a lighting device.

9. The elevator installation of claim 7, the one or more environmental components comprising a multimedia device.

10. The elevator installation of claim 7, the one or more environmental components comprising an HVAC device.

11. The elevator installation of claim 7, the elevator control computer being further configured to operate the elevator car.

12. A system comprising:

an elevator control computer associated with an elevator area and communicatively coupled to hardware that controls operations of an elevator car in response to elevator calls;

a building control computer, separate from the elevator control computer, and associated with a building area separate from the elevator area;

a user profile database coupled to the elevator control computer and to the building control computer;

an environment information input device disposed in the elevator car and coupled to the elevator control computer, the environment information input device operable to receive environment input information for the elevator car;

an elevator environmental component coupled to the elevator control computer, and capable of being operated based upon the environment input information;

a building environmental component coupled to the building control computer; and an identification device identifying a user;

wherein the elevator control computer updates a user profile in the user profile database, the profile database comprising at least one computer-readable storage medium storing one or more records, each of which is associated with a given user and indicates one or more environmental preferences of the user, according to environment input information received from the environment information input device and the identification device identifying a user, and the building control computer controls the building environmental component based upon reading the updated user profile and operating the building environmental component according to the updated user profile.

13. The system of claim 12, the system further comprising a second environment information input device, the second environment information input device being coupled to the building control computer.

14. The system of claim 12, the user profile database being located remotely from at least one of the elevator control computer and the building control computer.

15. The system of claim 12, the user profile database being part of the building control computer or the elevator control computer.

16. The system of claim 12, the building control computer comprising a plurality of communicatively coupled computer devices.

17. One or more non-transitory computer-readable storage media having encoded thereon instructions that, when executed by one or more processors, cause the one or more processors to perform a method of influencing an environment in a building area having an associated building environment system serving the building area, an environment in a separate elevator area associated with an elevator system, the method comprising:

identifying a user of the elevator system;

receiving, at an input device for an elevator car of the elevator system, user environment input information for the elevator car, the elevator system communicatively coupled to hardware that controls operations of the elevator car in response to elevator calls;

receiving, at the hardware which controls operations of the elevator car, the environment input information from the input device for the elevator car;

operating, by the hardware which controls operations of the elevator car, an environmental component of the elevator system based upon the environment input information;

updating a user profile based on the received environment input information, the user profile stored in a database communicatively coupled to the elevator system and to the separate building environment system that controls building systems for the building area, wherein the database comprises at least one computer-readable storage medium storing one or more records, each of which is associated with a given user and indicates one or more environmental preferences of the user;

reading the updated user profile by the building environment system; and operating a component of the building environment system based on the updated user profile.

* * * * *